United States Patent [19]

Nattrass et al.

[11] 4,010,784

[45] Mar. 8, 1977

[54] BULK CONTAINERS

[76] Inventors: Frank Nattrass, "Fallows End", Brearton, Harrogate, Yorkshire; Peter Johnson Nattrass, "Tresco", Chain Lane, Knaresborough, Yorkshire, both of England

[22] Filed: Oct. 15, 1975

[21] Appl. No.: 622,740

Related U.S. Application Data

[63] Continuation-in-part of Ser. No. 454,870, March 26, 1974, abandoned.

[30] Foreign Application Priority Data

Mar. 4, 1973 United Kingdom ..... 15798/73

[52] U.S. Cl. ..... 150/1; 150/17; 150/12; 229/54 R

[51] Int. Cl.[2] ..... B65D 33/14

[58] Field of Search ..... 150/1, 11, 12, 1.7; 112/120, 141, 142, 144; 2/271; 229/54 R, 62

[56] References Cited

UNITED STATES PATENTS

| | | | |
|---|---|---|---|
| 724,316 | 3/1903 | Morris | 150/12 |
| 2,192,131 | 2/1940 | Fishwick | 229/54 R |
| 2,212,390 | 8/1940 | Conklin | 150/1.7 |
| 3,229,741 | 1/1966 | Ambrose | 150/1.7 |

FOREIGN PATENTS OR APPLICATIONS

| | | | |
|---|---|---|---|
| 461,856 | 6/1928 | Germany | 150/12 |

*Primary Examiner*—Ro E. Hart
*Attorney, Agent, or Firm*—Stevens, Davis, Miller & Mosher

[57] ABSTRACT

A bag for transporting bulk quantities of powdered or granular material, the bag having a top and four separate lifting loops disposed around the top, each loop having a bight and two spaced legs. Each leg is secured to the fabric of the bag by folding a section of the fabric to a substantially S-shaped configuration along fold lines extending from the top towards the bottom of the bag to form three overlying thicknesses of fabric and stitching through the three thicknesses of fabric and the leg. The resulting characteristic shape of the bag provides inherent stability to the bag and the stitching technique allows high factors of safety to be obtained. In a presently preferred embodiment, the filled bag has a shape resembling that of a wide-necked bottle, with a broader base and a tapered top.

18 Claims, 3 Drawing Figures

-FIG. 1-
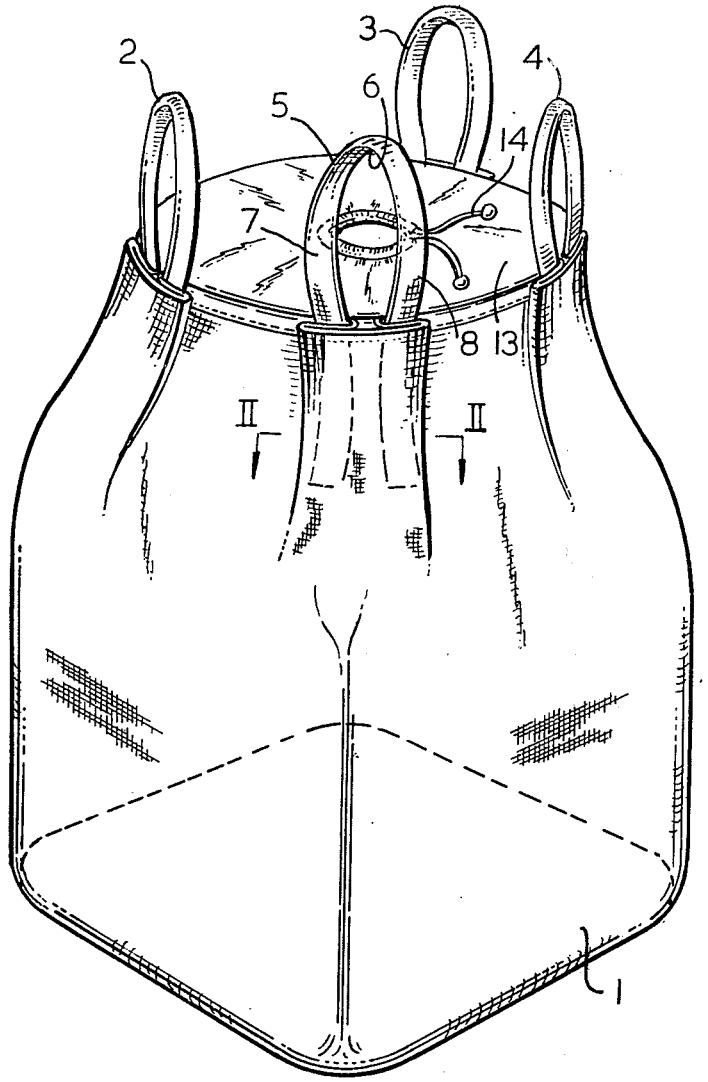
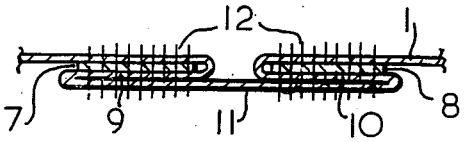
-FIG. 2-
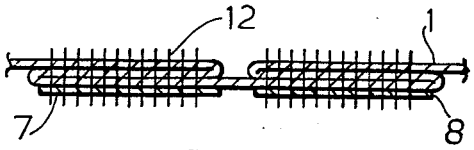
-FIG. 3-

BULK CONTAINERS

This application is a continuation-in-part of application Ser. No. 454,870 filed Mar. 26th, 1974, now abandoned and claiming priority from British application No. 15798/73 filed Apr. 3rd, 1973.

This invention relates to containers for bulk material, particularly for comminuted material.

The use of large bags for transporting bulk quantities of powdered or granular material is known, and it is known to use bags of a disposable form. In such bags the base of the bag is usually square and the top of the bag is formed with a drawstring encompassed by the fabric of the bag except at four corner points. The drawstring thus forms four lifting loops at these points. In use the bag is loaded through the open mouth and is then lifted by way of the loops. The drawstring effect closes the mouth of the bag. To empty the bag this is suspended by the loops over the receiving area and the bottom of the bag is cut away to allow the material to fall out.

One disadvantage with this type of bag is that when the bag is lifted by the loops very high stresses occur at the points where the drawstring enters the encompassing fabric at the four corners. This can result in early failure of the bags and gives a low factor of safety. This factor is generally about 2.5:1 with a bag designed for a load of 1 tonne (ton).

A further disadvantage is that there is no control of the distribution of the load in the upper part of the bag and the filled bags are often unstable due to uneven load distribution.

In accordance with the present invention a bag for transporting bulk material has a top and four separate lifting loops disposed around the top, each loop having a bight and two spaced legs, and each leg being secured to the fabric of the bag by folding a section of the fabric to a substantially S-shaped configuration extending from the top towards the bottom of the bag to form three overlying thicknesses of fabric and stitching through the three thicknesses of fabric and the leg.

In a bag according to the invention it will be seen that each leg of each loop is stitched to a total width of bag material which is three times the width of the loop material. As there are eight such legs the total width of bag fabric to which the lifting load is transmitted is 24 times the width of the loop material. By proper choice of materials it is possible to provide a bag that is no more expensive than existing bags and yet has a much greater equivalent safety factor.

Furthermore the gathering-in of the fabric at the upper part of the bag during the folding and stitching operations gives to the bag a characteristic shape having a broader bottom and a tapered top. This configuration both assists proper load distribution and provides inherent stability to the bag thus resulting in a further unexpected advantage over previous bags.

The conventional size of bags with which the invention is concerned is designed to carry one tonne of comminuted material. To support this weight it is desirable to use loop material which is at least 2 inches wide and to make the bag from material having a tensile strength of at least 50 kg. per linear inch. The lifting load will be transmitted to a total width of bag material of 48 inches and the maximum load supported will be 2.4 tonne, i.e. the bag will have a safety factor for a tonne load that is 2.4, i.e. similar to that of bags already in use.

However, the safety factor can readily be raised above this and it is desirable that this should be done. The proper way to lift or suspend bags according to the invention is to engage all four lifting loops to dispose them substantially vertical. However, it must be recognized that mishandling can occur and that a loaded bag may be engaged on one loop only; this leads to a requirement of a minimum safety factor of 4, and desirably somewhat above this. Accordingly the tensile strength of the bag material is preferably at least 83.3 kg. per linear inch.

Obviously these minimum tensile strength figures will change if the width of the loop material is changed, and can be reduced if the material loop width is increased above 2 inches.

Conveniently the material of the bag is woven from a high tenacity synthetic fibre, for example polypropylene, polyethylene terephthalate, rayon, nylon and mixtures thereof. It may be possible to use a strong natural fibre, such as jute, but generally synthetic fibres are stronger and more resistant to deterioration. A particularly preferred material for the bag is 15 × 15 per sq. inch woven polypropylene of 2000 denier, which is relatively cheap and possesses the required strength. Polypropylene has a tensile strength of 5 gms per denier and a single 2000 denier tape will thus support 10,000 gms. With a weave of 15 tapes per inch width the tensile strength per inch is thus 150 kg., well above the preferred minimum figure of 83.3 kg.. With 48 inches of material taking the load the maximum supported load will be 7.2 tonne, giving a safety factor for a tonne load of 7.2, significantly higher than that of conventional bags, even though the bag is no more expensive than conventional bags.

To maintain the safety factor given by the bag material it is obviously desirable to choose loop material giving the same safety factor. Thus, the absolute minimum breaking load of the loop material should be 600 kg., with the preferred minimum being 1000 kg.. The material of each loop is preferably woven Terylene (polyethylene terephthalate) of the type used for vehicle seat belts. A 2 inch width of this material has a breaking load of 1810 kg. so that four lifting loops will give a total load capacity of 7.24 tonne, i.e. a safety factor of 7.24 thus making such material particularly suitable for use with the woven polypropylene described above.

The material of each leg of each loop may lie between two adjacent thicknesses of the bag fabric or may lie on one or the other surface of the respective folded section of the bag fabric. The top of the bag may be provided with a cover stitched to the fabric of the bag, the cover having a central opening which may be closed by a drawstring to protect the material in the bag.

In order that the invention may be better understood a specific embodiment of a bag made in accordance therewith will now be described in more detail, with reference to the accompanying drawings in which:

FIG. 1 is a schematic perspective view of a bag;

FIG. 2 is a cross-section on the line II of FIG. 1 through a loop stitched to the bag; and FIG. 3 is a cross-section similar to FIG. 2 of an alternative arrangement.

The bag is formed with a body 1 having a substantially square base, the preferred fabric for the body and base being 15 × 15 per sq. inch woven polypropylene of 2000 denier. Towards the top of the body the fabric is gathered in, and four lifting loops 2 to 5 are secured to the fabric. Each loop (e.g. loop 2) comprises a bight 6 and two spaced legs 7 and 8. Each leg is secured to the fabric of the bag body by folding a section of the fabric at the upper part of the bag in a substantially S-shaped configuration around the leg and then back upon itself. Thus, spaced legs 7 and 8 overlie the bag fabric 1 and this is folded back over the respective legs to give sections 9, 10 and then folded back upon itself to give a section 11. Each leg is secured to the fabric by stitching 12 through the three thicknesses of bag fabric and through the material of the leg. In the alternative arrangement shown in FIG. 3 each leg 7, 8 does not lie between adjacent thicknesses of the bag fabric but rather lies on one surface of the respective folded section of the bag fabric.

The material used for the loops is preferably woven Terylene webbing as used for vehicle seat belts. With webbing two inches wide it will be seen that a six inch width of bag fabric is stitched to each leg and the total width of bag fabric available to take the transmitted load from the loops is 48 inches.

The bag includes a cover 13 stitched to the bag fabric around the mouth at the upper end thereof, and the cover has a drawstring 14 surrounding a central opening.

The bag shown may be lined with a detachable or fixed liner, which may for example be of polyethylene to prevent migration of fine particles of powder through the fabric of the bag wall.

Once the bag as shown has been filled, and the drawstring of the cover tied, the bag may then be lifted by the loops. As is apparent from the drawings the bag has a shape resembling that of a wide-necked bottle, with a broader base and a tapered top. A number of bags may be stacked one on top of another, with the bottom of one bag lying on the cover of another. The characteristic squat shape due to the folding and stitching of the upper part of the bag leads to excellent stability, and the loaded bag carries well by suspension from either a crane or a fork lift truck. A bag designed to carry one tonne of powdered material would have a base approximately 35 inches square and a height of approximately 50 inches. If made from the preferred materials described the bag will have a safety factor of 7.2.

As described the bag is not reusable after the bottom has been cut to release the materials. A reusable bag may be made however by cutting a hole (which may be round or square) in the base, hemming the cut edges to prevent tearing of the material and laying a sheet of heavy gauge polyethylene or other sheeting over the hole and surrounding part of the base of the bag. Material can then be loaded into the bag, and, providing the ratio of total base area to area of the hole in the base is above a certain minimum (readily determined empirically), the pressure of the material on the floor of the bag surrounding the hole maintains sufficient tension in the sheeting to prevent it from being pushed out of the hole. To empty the bag the sheeting is cut, and a new piece of sheeting is put in the bag before reuse.

In a further modification the bag may be formed with a drawstring closure at the base, although this is more expensive. However, it does have the added advantage of giving a degree of control over the flow from the container.

What we claim is:

1. A bag for transporting bulk material, the bag having a top and having four separate lifting loops disposed around the top, each loop having a bight and two spaced legs, and each leg being secured to the fabric of the bag by being disposed along a section of the fabric folded to a substantially S-shaped configuration along fold lines extending from the top towards the bottom of the bag to form three overlying thicknesses of fabric and stitching through the three thicknesses of fabric and the leg.

2. A bag according to claim 1 in which the material of each loop is at least 2 inches wide and the material of the bag has a tensile strength of at least 50 kg. per linear inch.

3. A bag according to claim 2 in which the material of the bag has a tensile strength of at least 83.3 kg. per linear inch.

4. A bag according to claim 2 in which the material of the bag has a tensile strength of about 150 kg. per linear inch.

5. A bag according to claim 1 in which the material of the bag is woven from a high tenacity synthetic fibre.

6. A bag according to claim 5 in which the material of the bag is 15 × 15 per sq. inch woven polypropylene of 2000 denier.

7. A bag according to claim 1 in which the material of each loop has a breaking load of at least 600 kg..

8. A bag according to claim 7 in which the material of each loop has a breaking load of at least 1000 kg..

9. A bag according to claim 7 in which the material of each loop has a breaking load of about 1810 kg..

10. A bag according to claim 1 in which the material of each loop is woven polyethylene terephthalate.

11. A bag according to claim 1 in which the top of the bag is provided with a cover stitched to the fabric of the bag, the cover having a central opening which may be closed by a drawstring.

12. A bag according to claim 1 in which the filled bag has a shape resembling that of a wide-necked bottle, with a broader base and a tapered top.

13. A bag for transporting bulk material, the bag having an open top and having four separate lifting loops disposed around the open top, each loop having a bight and two spaced legs, and each leg being secured to the fabric of the bag by folding the fabric around the leg and then back over itself along fold lines extending from the top towards the bottom of the bag and stitching through the three widths of fabric and the leg.

14. A bag according to claim 13 in which the material of each loop is at least 2 inches wide and the material of the bag has a tensile strength of about 150 kg. per linear inch.

15. A bag according to claim 13 in which the material of the bag is 15 × 15 per sq. inch woven polypropylene of 2000 denier.

16. A bag according to claim 13 in which the material of each loop has a breaking load of about 1810 kg..

17. A bag according to claim 13 in which the material of each loop is woven polyethylene terephthalate.

18. A bag according to claim 13 in which the filled bag has a shape resembling that of a wide-necked bottle, with a broader base and a tapered top.

* * * * *